US010792530B2

(12) United States Patent
Towley, III

(10) Patent No.: US 10,792,530 B2
(45) Date of Patent: Oct. 6, 2020

(54) SET OF DUMBBELLS

(71) Applicant: Carl K. Towley, III, Sebastian, FL (US)

(72) Inventor: Carl K. Towley, III, Sebastian, FL (US)

(73) Assignee: PowerBlock Holdings, Inc., Owatonna, MN (US)

( * ) Notice: Subject to any disclaimer, the term of this patent is extended or adjusted under 35 U.S.C. 154(b) by 0 days.

(21) Appl. No.: 15/837,699

(22) Filed: Dec. 11, 2017

(65) Prior Publication Data

US 2019/0175979 A1 Jun. 13, 2019

(51) Int. Cl.

| | |
|---|---|
| ***A63B 21/075*** | (2006.01) |
| ***A63B 21/072*** | (2006.01) |
| ***A63B 71/00*** | (2006.01) |
| ***A63B 21/06*** | (2006.01) |

(52) U.S. Cl.

CPC ..... *A63B 21/075* (2013.01); *A63B 21/0604* (2013.01); *A63B 21/0726* (2013.01); *A63B 21/0728* (2013.01); *A63B 71/0036* (2013.01)

(58) Field of Classification Search

CPC ..... A63B 21/075; A63B 21/0728; A63B 21/0604; A63B 21/0726; A63B 71/0036

See application file for complete search history.

(56) References Cited

U.S. PATENT DOCUMENTS 4,743,017 A 5/1988 Jaeger
5,637,064 A * 6/1997 Olson ..... A63B 21/0728 482/107
5,769,762 A * 6/1998 Towley, III ..... A63B 21/0605 482/107
5,779,604 A * 7/1998 Towley, III ..... A63B 21/0728 482/107
5,971,899 A * 10/1999 Towley, III ..... A63B 21/0605 482/107
6,083,144 A * 7/2000 Towley, III ..... A63B 21/0605 482/107
7,011,611 B1 * 3/2006 Ripley ..... A63B 21/0728 482/107

(Continued)

FOREIGN PATENT DOCUMENTS

FR 637365 A 4/1928
JP 2009254553 A 11/2009

OTHER PUBLICATIONS

KIPO, Written Opinion of the International Searching Authority in PCTIB2018059535, Mar. 15, 2019.

(Continued)

*Primary Examiner* — Andrew S Lo
(74) *Attorney, Agent, or Firm* — James W. Miller

(57) ABSTRACT

A set of dumbbells comprises a plurality of dumbbells of different weights with the dumbbells having a common length. A plurality of adder weights is provided with each adder weight having a cavity that is sized to receive the common length of any one of the dumbbells. Any one of the dumbbells is dropped down into the cavity of any one of the adder weights. A slide retainer is then slid into a slideway on the any one adder weight to overlie the dumbbell and secure the dumbbell to the any one adder weight. The slide retainer has a window therein to allow a user to reach through the slide retainer and grip a hand grip of the dumbbell.

18 Claims, 6 Drawing Sheets

(56) References Cited

U.S. PATENT DOCUMENTS

| | | | | |
|---|---|---|---|---|
| 7,578,771 | B1 * | 8/2009 | Towley, III | A63B 1/04 482/106 |
| 9,138,611 | B2 | 9/2015 | Towley, III | |
| 9,814,421 | B2 * | 11/2017 | Edwards | A61B 5/221 |
| 2002/0002106 | A1 | 1/2002 | Krull | |
| 2003/0114276 | A1 * | 6/2003 | Schiff | A63B 21/0728 482/93 |
| 2003/0148862 | A1 * | 8/2003 | Chen | A63B 21/0726 482/108 |
| 2004/0259697 | A1 * | 12/2004 | Whetstone | A63B 71/0036 482/94 |
| 2006/0035766 | A1 * | 2/2006 | Towley, III | A63B 21/0605 482/97 |
| 2009/0042700 | A1 | 2/2009 | Liu | |
| 2010/0261587 | A1 | 10/2010 | Towley, III | |
| 2014/0274596 | A1 * | 9/2014 | Krull | A63B 21/0724 482/107 |
| 2014/0274597 | A1 * | 9/2014 | Towley, III | A63B 21/075 482/108 |
| 2015/0360073 | A1 | 12/2015 | Moran et al. | |
| 2016/0361584 | A1 * | 12/2016 | Towley | A63B 21/06 |
| 2017/0056703 | A1 * | 3/2017 | Phelps | A63B 21/075 |
| 2017/0209731 | A1 * | 7/2017 | Towley, III | A63B 21/075 |

OTHER PUBLICATIONS

KIPO, International Search Report in PCTIB2018059535, Mar. 15, 2019.

* cited by examiner

SET OF DUMBBELLS

TECHNICAL FIELD

This invention relates to a set of dumbbells that is particularly suited for use in a multi-user exercise facility.

BACKGROUND OF THE INVENTION

FIG. 1 depicts a typical set of dumbbells that is often used in a multi-user exercise facility, such as a weight room for a sports team, a commercial fitness center or gym, and the like. In the dumbbell set shown in FIG. 1, multiple pairs of dumbbells are provided in five pound increments within a range beginning at five pounds and ending at one hundred pounds. This permits a user to select a dumbbell pair to exercise with having a weight most suited to the user's age, general level of fitness and strength, and his or her exercise objectives. If the user is an average person who is interested in simply maintaining an adequate but not overly strong general level of fitness, the user would most likely exercise with weights in the lower part of the range. On the other hand, if the user is a person who is dedicated to body building, this type of user would most likely exercise with weights in the higher part of the range.

As a result, a dumbbell set used in a multi-user exercise facility must have a large range of weights available from very light to very heavy. Such a dumbbell set is very heavy and thus relatively costly to purchase. In the dumbbell set shown in FIG. 1, the total weight of the set is 2,100 pounds. In addition, when the dumbbell set is stored on a rack as is typical as depicted in FIG. 1, the dumbbell set requires significant floor space.

Moreover, for all its weight and size, only one person at a time can exercise with a pair of dumbbells having a given weight. For example, if there are three people who wish to use the thirty pound pair of dumbbells, two of them will have to wait and take their turns sequentially after the person who is currently using the pair finishes his or her exercise routine. Since multi-user exercise facilities have peak times during the day when they are most crowded, a demand by multiple users for a particular pair of dumbbells having a particularly desirable weight is quite common. This disadvantage could be mitigated to some extent if multiple sets of dumbbells were available to a user instead of just one set. However, many multi-user facilities cannot justify the purchase expense for acquiring multiple dumbbell sets or possess the floor space needed to accommodate multiple dumbbell sets. Thus, when one walks in to most multi-user exercise facilities, one will typically see only set of dumbbells if there are any at all.

SUMMARY OF THE INVENTION

Brief Description of the Drawings

This invention will be described more fully in the following Detailed Description, when taken in conjunction with the following drawings, in which like reference numerals refer to like elements throughout.

DETAILED DESCRIPTION

Figure 2:
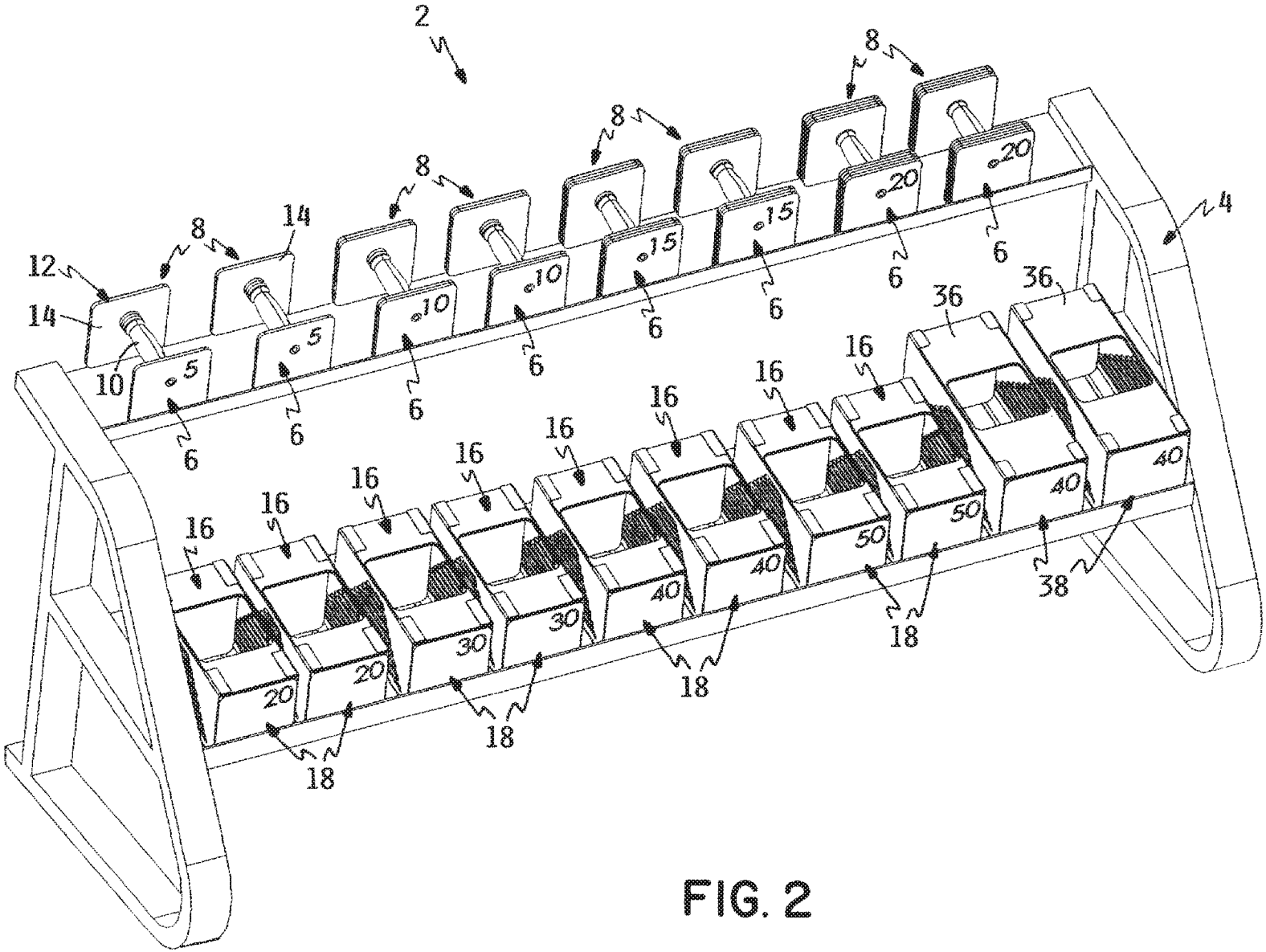
FIG. 2 is a perspective view of a racked set of dumbbells according to this invention.

FIG. 2 depicts a dumbbell set 2 according to one embodiment of this invention stored on a rack 4. Dumbbell set 2 comprises a plurality of dumbbells 6 which are depicted on the top shelf of rack 4. There are four pairs 8 of dumbbells 6 in five pound increments within a range beginning at five pounds and ending at twenty pounds. The increments of weight between dumbbell pairs 8 and the range of weight covered by dumbbell pairs 8 may vary. By way of example, there could be four dumbbell pairs 8 in two and a half pound increments within a range beginning at two and a half pounds and ending at ten pounds, or eight dumbbell pairs 8 in two and a half pound increments within a range beginning at two and a half pounds and ending at twenty pounds. The word dumbbell is used herein in accordance with one of its customary definitions to mean a short bar or hand grip with weights at each end used for exercise or building muscles.

Figure 7:
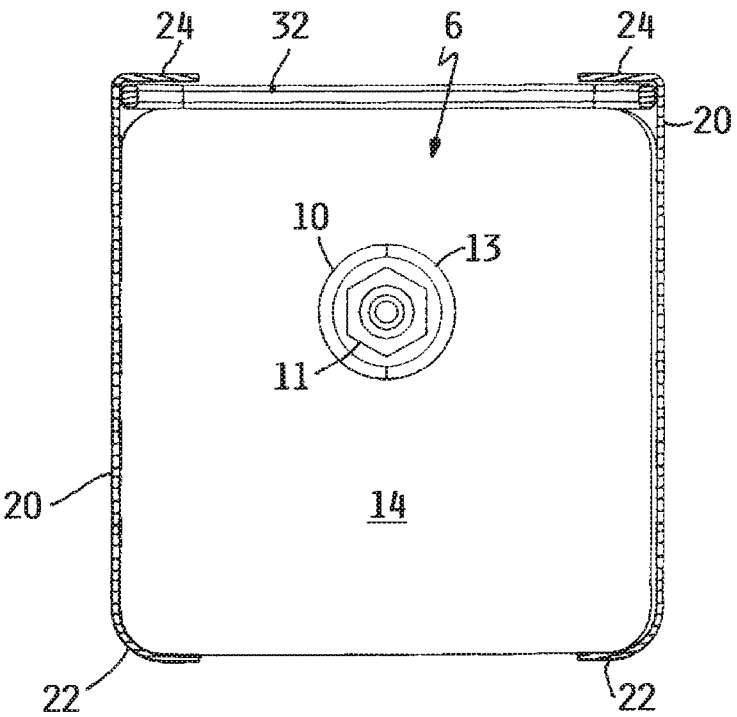
FIG. 7 is a cross sectional view taken along lines 7-7 in FIG. 6.

Each dumbbell 6 comprises a hand grip 10 coupled to a weight 12 at each end of hand grip 10. The coupling between hand grip 10 and each weight 12 could be an integral one, such as a welded connection when the parts are made of steel or another metal. The coupling could also be a releasable one, such as a threaded connection. In addition, hand grip 10 could be a single piece in the form of an integral bar. Alternatively, hand grip 10 could comprise multiple pieces where an inner bar 11 is covered by an outer grip material 13 as shown in FIG. 7, the grip material having different exterior contours or shapes if so desired.

Figure 3:
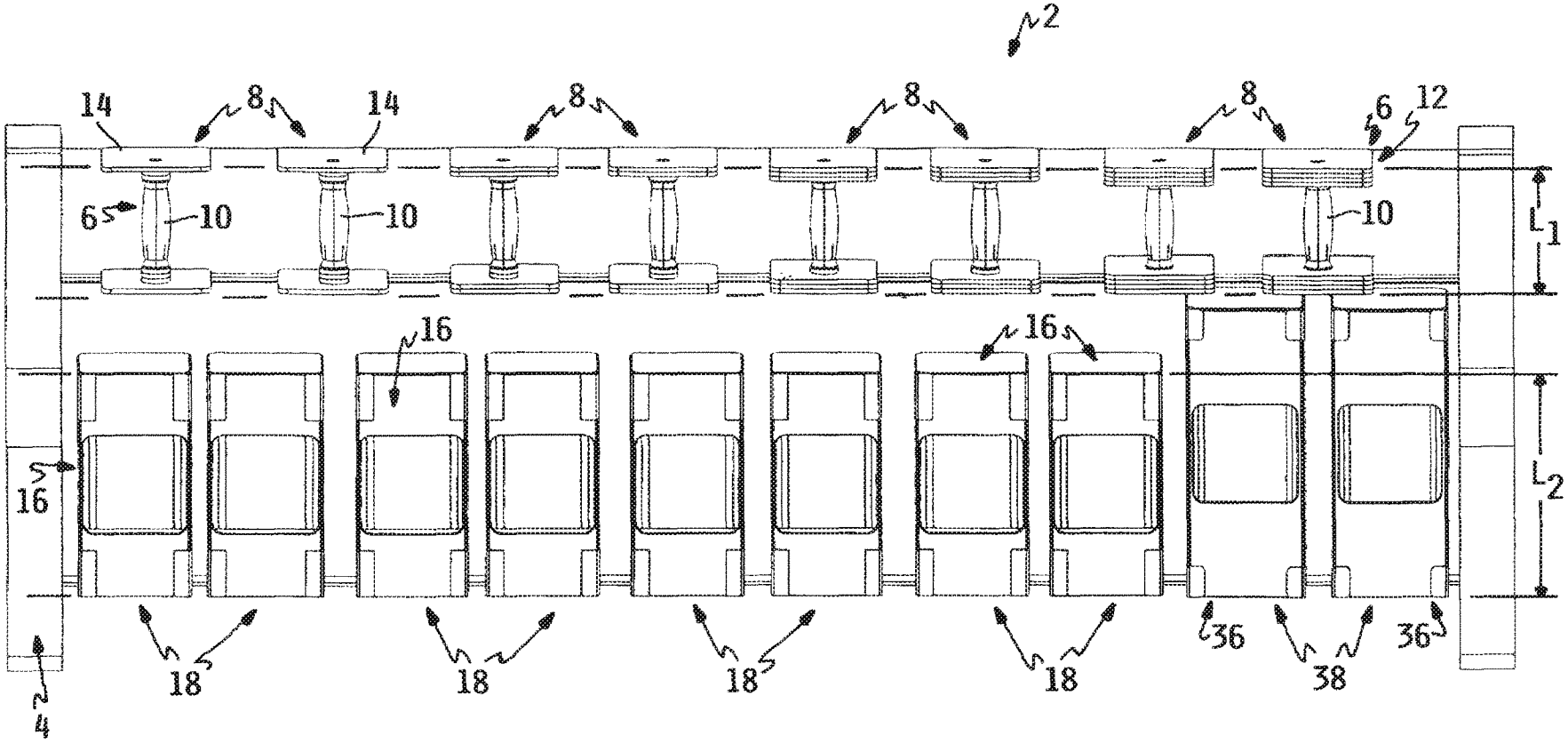
FIG. 3 is a top view of the set of dumbbells of FIG. 2.

Each weight 12 preferably, but not necessarily, comprises one or more weight plates 14. Dumbbells 6 of greater weight preferably have progressively greater numbers of weight plates 14 attached to the ends of hand grip 10 to provide the additional mass needed as dumbbells 6 get progressively heavier. As shown in FIGS. 2 and 3, each five pound dumbbell has a single weight plate 14 at each end of hand grip 10, each ten pound dumbbell has two weight plates 14 at each end of hand grip 10, each fifteen pound dumbbell has three weight plates 14 at each end of hand grip 10, and each twenty pound dumbbell has four weight plates 14 at each end of hand grip 10. Alternatively, a single weight 12 of constant thickness could be used at each end of hand grip 10 with the variation in mass being provided by drilled out portions in the lightest dumbbell which drilled out portions progressively decrease in number and/or in size in the single weight plates of the progressively heavier dumbbells.

Referring now to FIG. 3, each dumbbell 6 has a substantially common length denoted as $L_1$, the lengths of all dumbbells 6 are substantially equal to each other. In the depicted embodiment of the invention, this is achieved by stacking the additional weight plates 14 to the inside of the single weight plate 14 at each end of hand grip 10 of the lightest dumbbell, namely the five pound dumbbell shown in FIGS. 2 and 3. This requires hand grip 10 of each progressively heavier dumbbell to become progressively slightly shorter to accommodate the progressive addition of the weight plates 14 to the inside of the outermost weight plate 14. Thus, in FIG. 3, the pair of five pound dumbbells at the far left of the top shelf of rack 4 has the longest hand grips 10 while the successive dumbbell pairs 8 as one proceeds from left to right have slightly shorter hand grips 10. However, the shortest hand grip 19 in any dumbbell pair 8, namely in the heaviest pair of twenty pound dumbbells 6 shown on the far right in FIG. 3, is long enough to be comfortably gripped by a user with even very large hands. In the alternative embodiment described above where the variation in mass between the respective dumbbells 6 is accomplished by drilled out portions of a single constant thickness weight 12 instead of by using additional weight plates 14 of the same thickness, hand grips 10 may remain the same length in all dumbbells 6.

Figure 4:
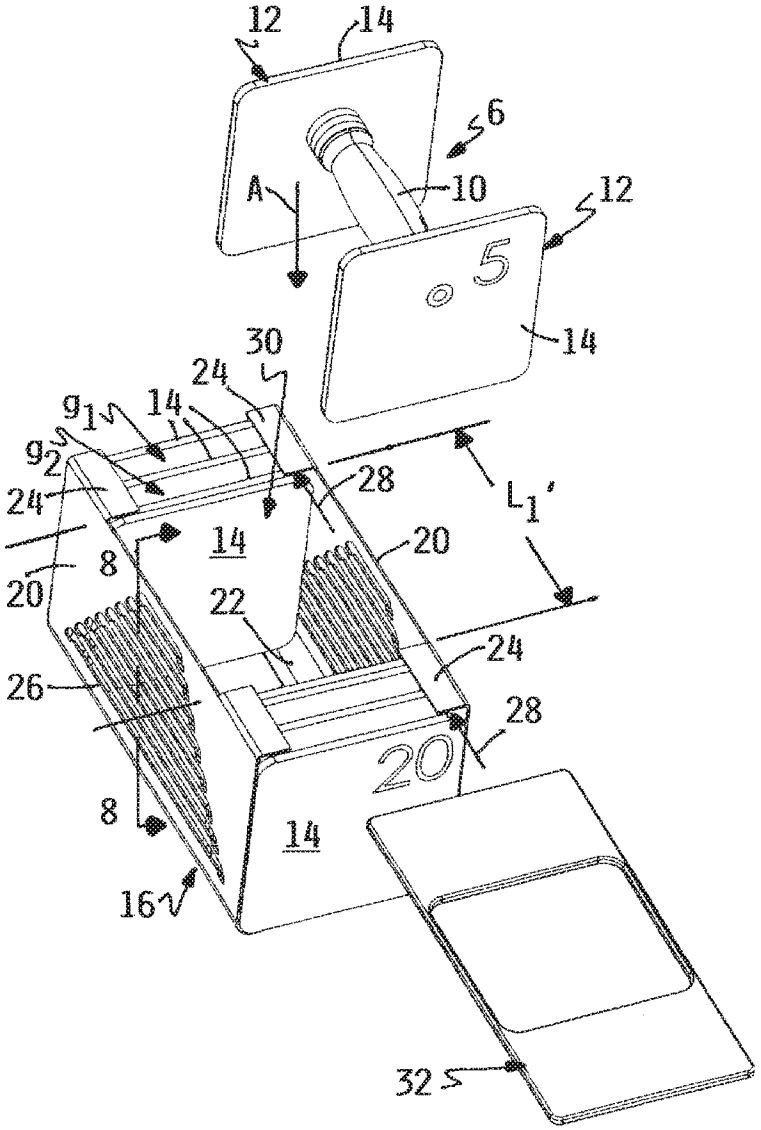
FIG. 4 is an exploded perspective view of various components of the set of dumbbells of FIG. 2, namely of one dumbbell, one first adder weight, and one first retainer.

Referring further to FIGS. 3 and 4, one embodiment of dumbbell set 2 of this invention further comprises a plurality of first adder weights 16 which are depicted on the bottom shelf of rack 4. There are four pairs 18 of first adder weights 16 in ten pound increments within a range beginning at twenty pounds and ending at fifty pounds. The increments of weight between first adder weight pairs 18 and the range of weight covered by first adder weight pairs 18 may vary. By way of example, there could be five pairs 18 of first adder weights 16 in five pound increments within a range beginning at twenty pounds and ending at forty pounds, or seven pairs of first adder weights in five pound increments within a range beginning at twenty pounds and ending at fifty pounds.

Referring now to FIGS. 4 and 7, each first adder weight 16 comprises a pair of side walls 20. Side walls 20 are identical to one another to allow side walls 20 to be manufactured from the same tooling. Each side wall 20 has an inwardly turned bottom flange 22 extending substantially along the entire length of side wall 20. Each side wall 20 further has two inwardly turned front and rear upper tabs 24 at the front and rear ends of each side wall 20. When assembled, side walls 20 of each first adder weight 16 are placed in a facing relationship to each other with bottom flanges 22 and upper tabs 24 on each side wall 20 extending inwardly towards one another. A decorative design 26 may be cut, etched or embossed if so desired onto the external face of each side wall 20. Alternatively, each side wall 20 could be planar without any such design.

Referring further to FIG. 4, side walls 20 of each first adder weight 16 are held together by a plurality of adder weight plates 14 at either end that are integrally fixed between side walls 20. In the case of the twenty pound first adder weight shown in FIG. 4, there are four weight plates 14 at each end with a couple of gaps $g_1$ and $g_2$ being disposed between some of the weight plates. Each adder weight plate 14 will be rigidly affixed, e.g. by welding when side walls 20 and weight plates are made of a metal such as steel, both to the internal surface of each side wall 20 and to bottom flanges 22 to rigidly join the two side walls 20 together and make first adder weight 16 a complete, assembled unit. When so assembled, upper tabs 24 on side walls 20 of first adder weight 16 are spaced above the plane defined by the upper edges of weight plates 14 to form a slideway 28 therebetween.

Figure 5:
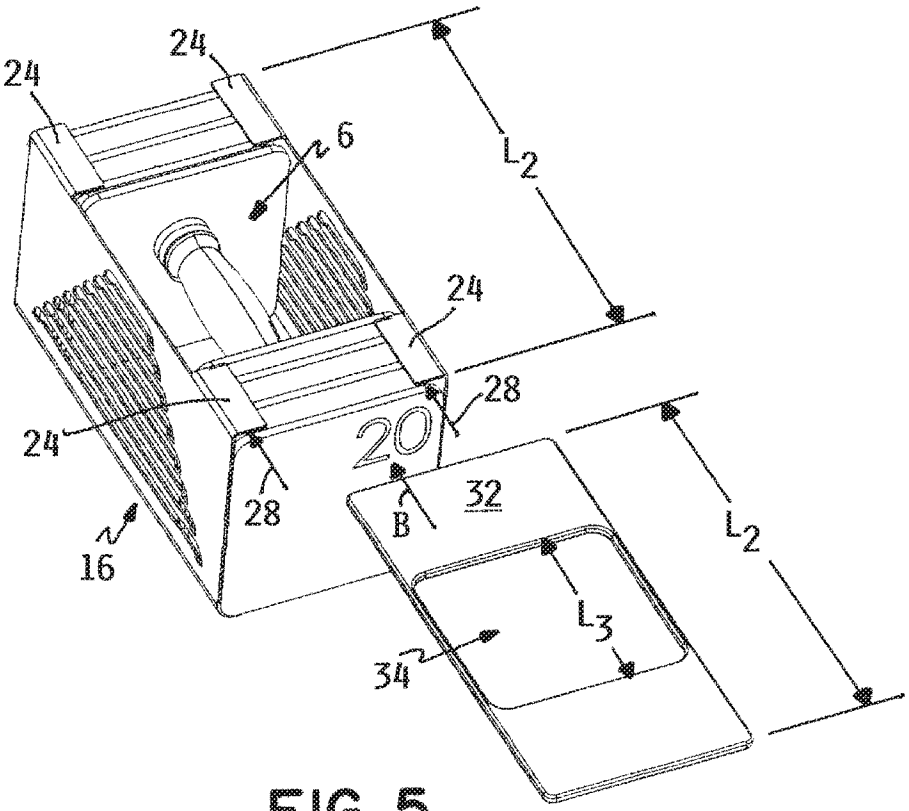
FIG. 5 is a view similar to that of FIG. 4, particularly illustrating the dumbbell having been inserted into the cavity provided in the first adder weight therefor but with the first retainer not having been inserted.

The innermost weight plate 14 at one end of first adder weight 16 shown in FIG. 4 is spaced from the innermost weight plate 14 at the other end of first adder weight 16 by a length that is denoted as $L_{1'}$ to form a cavity 30 in the middle portion of first adder weight 16. The cavity length $L_{1'}$ is slightly longer than length $L_1$ of each of dumbbells 6, e.g., 0.025 to 0.075 inches longer, to provide just enough clearance to drop any one dumbbell 7 down into cavity 30 provided in the middle portion of first adder weight 16. FIG. 4 shows one dumbbell 6 located above cavity 30 of first adder weight 16. Dumbbell 6 will be aligned with cavity 30 and then dropped down into cavity 30 by lowering dumbbell 6 in the direction of the arrow A in FIG. 4. FIG. 5 shows dumbbell 6 having been dropped down into cavity 30 to be snugly received in cavity 30 between the innermost weight plates 14 that define the opposite ends of cavity 30 and between side walls 20 of first adder weight 16. The cavity lengths $L_{1'}$ in all of first adder weights 16 are substantially equal to one another so that any dumbbell 6 could be dropped down into cavity 30 of any first adder weight 16.

As shown in FIG. 3, each first adder weight has a substantially common length denoted as $L_2$. In order to make the successive pairs of first adder weights 16 progressively heavier than the lightest first adder weight 16 depicted in FIG. 4, gaps $g_1$ and $g_2$ in the lightest first adder weight 16 are progressively filled in with additional weight plates 14 to provide the progressively heavier weights 16. Thus, in the heaviest first adder weight 16, namely the fifty pound first adder weight 16, gaps $g_1$ and $g_2$ have been entirely filled in such that the weight plates at either end of the fifty pound first adder weight are disposed in a solid stack. Other ways of accomplishing the weight variation in first adder weights 16 while keeping the length $L_2$ of first adder weights 16 substantially the same length and while keeping the length $L_{1'}$ of cavities 30 in first adder weights 16 substantially the same length could be used, such as use of drilled out portions in a single thick weight plate at each end of first adder weight 16 as described above with respect to dumbbells 6.

Turning to FIG. 5, each first adder weight 16 includes a first retainer 32 in the form of a substantially planar and rigid member, preferably but not necessarily made of metal, having a central window 34. First retainer 32 has substantially the same length $L_2$ as first adder weight 16 with which it is used. Window 34 has a length $L_3$ that is shorter, e.g. 0.25 to 0.75 inches shorter, than the length $L_1$ of each dumbbell 6. First retainer 32 can be installed on first adder weight 16 by sliding first retainer 32 in the direction of the arrow B in FIG. 5 into and along the length of slideway 28 formed by the inwardly turned upper tabs 24 of first adder weight 16. One end of first retainer 32 may include an upwardly extending tab (not shown) which the user can use as a handle to slide first retainer 32 in the direction of the arrow B. The same end of first retainer 32 may have a downwardly extending flange (not shown) that abuts against one end of first adder weight 16 when first retainer 32 has been fully slid into place in slideway 28.

Figure 6:
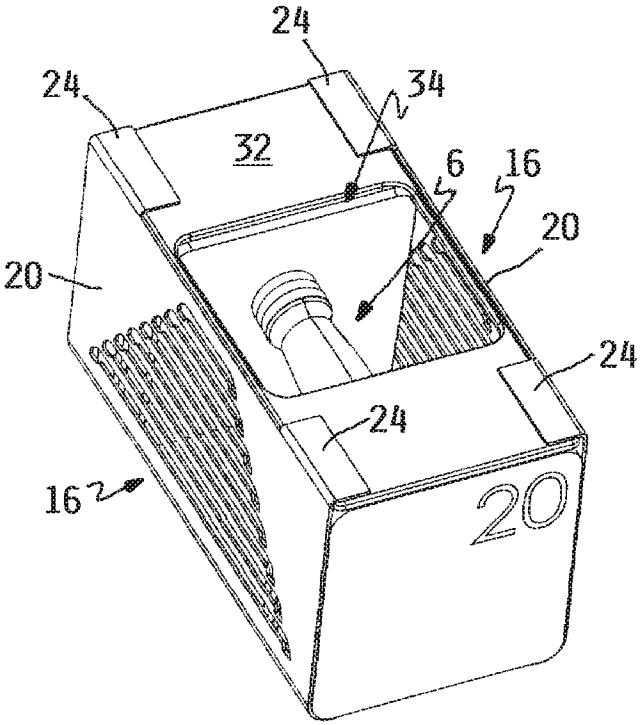
FIG. 6 is a view similar to that of FIG. 5, but showing the first retainer inserted into the first adder weight to retain the dumbbell in the cavity in the first adder weight during an exercise activity.

As shown in FIG. 6, when first retainer 32 is fully inserted into the slideway, first retainer 32 will overlie the weight stacks at either end of first adder weight 16 and overlie at least the outermost weight plate of each dumbbell 6 to retain the dumbbell within cavity 30 of first adder weight 16. Window 34 will be positioned over hand grip 10 of the dumbbell to allow the user to reach down through window 34 to grip hand grip 10. Now, when the user lifts up on hand grip 10 to exercise with dumbbell 6, the effective mass of dumbbell 6 has been increased by the weight of first adder weight 16 coupled to dumbbell 6. In the example shown in FIGS. 4-6, five pound dumbbell 6 has now been made into a twenty five pound dumbbell since five pound dumbbell 6 was dropped into a twenty pound first adder weight 16. Obviously, five pound dumbbell 6 could have been made into a thirty five pound dumbbell, a forty five pound dumbbell, or a fifty five pound dumbbell if the five pound dumbbell 6 had been dropped into one of the progressively heavier first adder weights 16.

Figure 8:
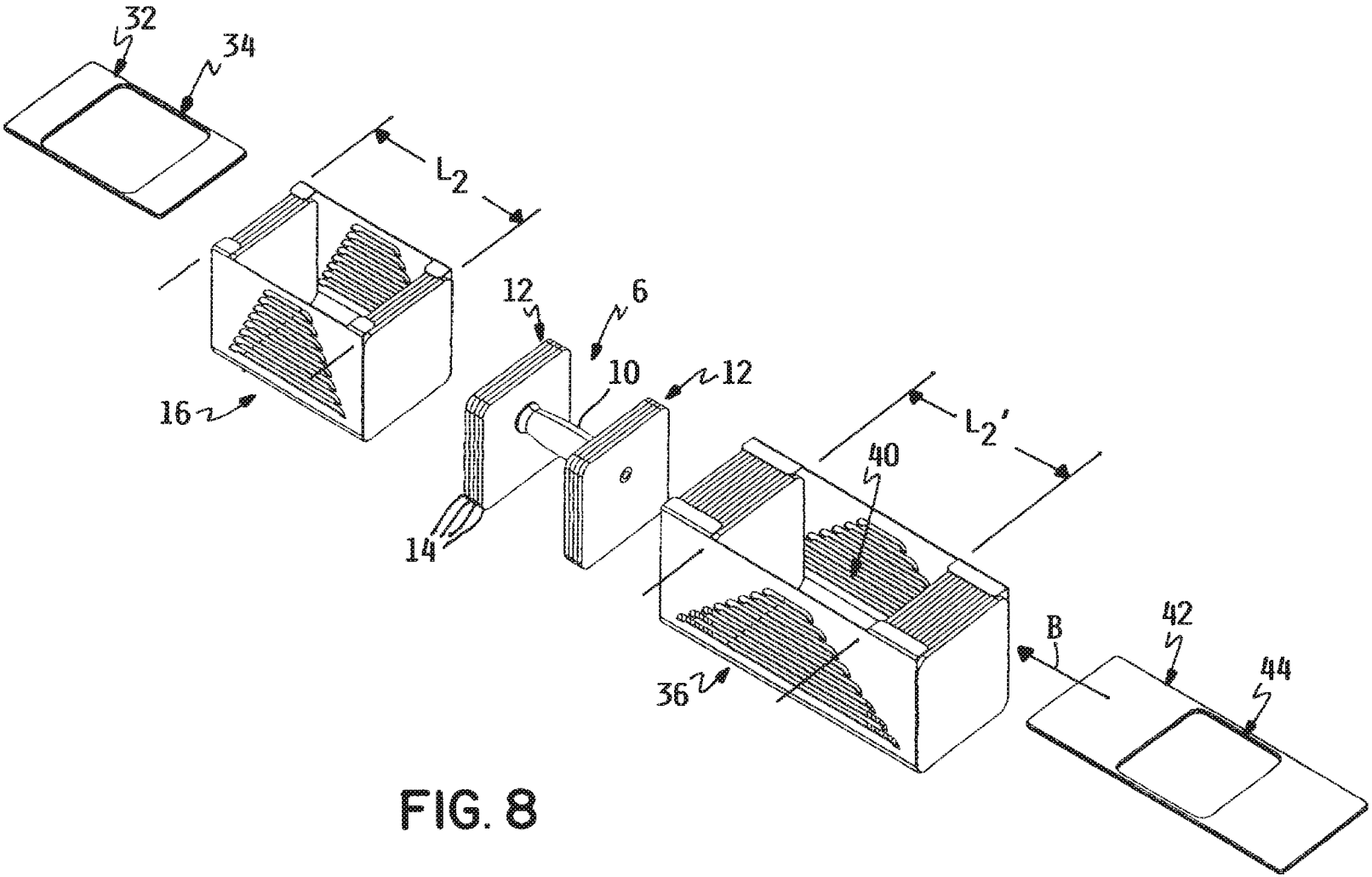
FIG. 8 is an exploded perspective view of various components of the set of dumbbells of FIG. 2, namely of one dumbbell, one first adder weight, one first retainer, one second adder weight, and one second retainer.

In addition, in one embodiment of dumbbell set 2 of this invention, a pair 38 of second adder weights 36 is provided, namely the pair 38 of forty pound second adder weights 36 shown in FIGS. 2 and 3 on the far right of the lower shelf of rack 4. Referring now to FIG. 8, each second adder weight 36 is substantially the same in construction as first adder weight 16 except that it has a cavity 40 with a length $L_{2'}$ that is slightly longer, e.g., 0.025 to 0.075 inches longer, than the length $L_2$ of each first adder weight 16. Thus, when a selected dumbbell 6 has been inserted into cavity 30 in first adder weight 16 and is retained therein by first retainer 32, that entire assemblage thereof as shown in FIG. 6 can then be dropped down into cavity 40 in any selected second adder weight 36. Then, a second retainer 42 for second adder weight 36 can be moved in the direction of the arrow B in FIG. 8 to slide into the slideway formed by tabs 24 of second adder weight 36 to couple second adder weight 36 to the assemblage comprising dumbbell 6, first adder weight 16, and first retainer 32. This increases the weight of such assemblage by the weight provided by second adder weight 36. Second adder weight 36 has a window 44 in second retainer 40 that is sized similarly to window 34 in first retainer 32 to continue to provide access to hand grip 10 of dumbbell 6.

Instead of having just one pair 38 of second adder weights 36, a plurality of pairs 38 of second adder weights 36 could be provided, e.g. a pair of thirty pound second adder weights, a pair of forty pound second adder weights, and a pair of fifty pound adder weights, if so desired. In each second adder weight 36, cavity 40 will have substantially the same length $L_{2'}$ as described above. Second adder weights 36 need not have the same length as they get heavier since they will not need to be nested in a cavity of a third adder weight. Thus, progressively heavier second adder weights 36 could be manufactured by stacking weight plates to the outside of the each end of the lightest second adder weight 36 such that each heavier second adder weight 36 increases in length as it gets heavier.

While an embodiment in which first adder weights 16 and one or more longer second adder weights are both used, the longer second adder weights could be dispensed with if so desire. In such an alternative, first adder weights 16 could also grow in length as first adder weights 16 get heavier rather than retaining substantially a common length.

Figure 1:
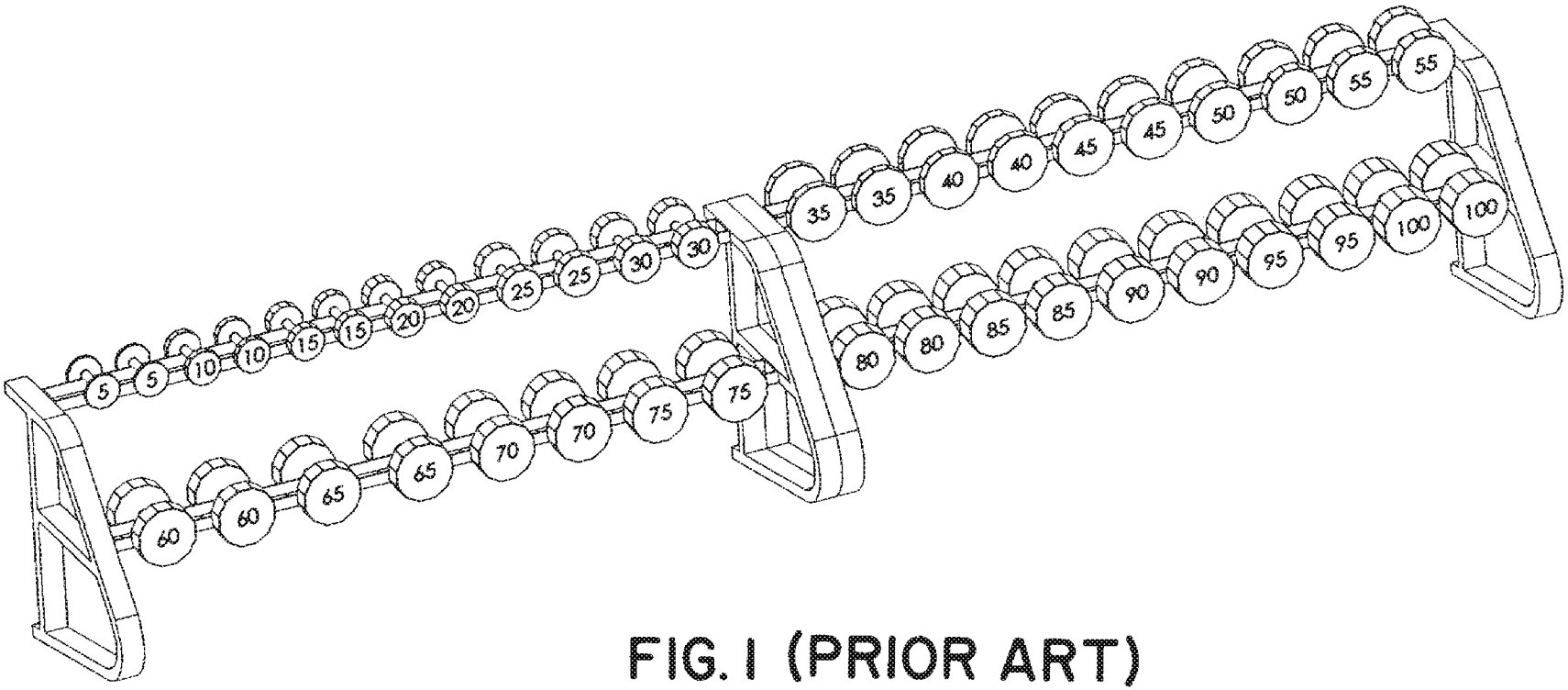
FIG. 1 (PRIOR ART)
FIG. 1 is a perspective view of a prior art racked set of dumbbells.

Each embodiment of dumbbell set 2 provides readily apparent advantages over a traditional dumbbell set as depicted in FIG. 1. First, the total weight of the embodiment of dumbbell set 2 as depicted in FIG. 2 comprises a total of only 460 pounds, only 22% of the weight of a traditional set of dumbbells having comparable functionality. Thus, for approximately the same cost as buying one traditional set of dumbbells, an owner or operator of a multi-user exercise facility could buy four dumbbell sets 2 according to this invention. In addition, each dumbbell set 2 takes up less floor space than the single traditional dumbbell set. Thus, it would be possible for an owner or operator of a multi-user exercise facility to space the extra dumbbell sets 2 that he or she could buy around the exercise facility in widely separated spots. This would allow users to have a dumbbell set 2 close to other machines or areas of the exercise facility where they would conduct other exercises without requiring such a user to trek all the way across the exercise facility to reach a dumbbell set 2.

Yet, despite the substantial reduction in weight and all the attendant cost savings and placement opportunities described above, each dumbbell set 2 of this invention allows a user to exercise at each weight in five pound increments in the range from five to one hundred pounds. For example, the five, ten, fifteen and twenty pound increments are met by use of the respective dumbbells 6 shown on the top shelf of rack 4 in FIG. 2. The twenty five, thirty five, forty five, and fifty five pound increments are met when the five pound dumbbell 6 is dropped down and used with an individual one of first adder weights 16, respectively. The thirty, forty, fifty, and sixty pound increments are met when the ten pound dumbbell 6 is dropped down and used with an individual one of first adder weights 16, respectively. All of the remaining increments, namely sixty five pounds through one hundred pounds, are met when the forty pound second adder weight 36 is added to each of the increments produced by the dumbbell/first adder weight combinations set forth in the preceding two sentences. For example, the sixty five pound increment is met when the five pound dumbbell/twenty pound first adder weight assembly is dropped down into and used with the forty pound second adder weight 36, the seventy pound increment is met when the ten pound dumbbell/twenty pound first adder weight assembly is dropped down into and used with the 40 pound second adder weight 36, and so on. Thus, dumbbell set 2 of this invention allows a user to exercise in five pound increments from 5 to 100 pounds but weighs only 460 pounds versus the 2100 pounds that a traditional set of dumbbells requires to provide the same functionality.

Another advantage of dumbbell set 2 of this invention is the mix and match capabilities provided by the array of differently weighted dumbbells 6 and the differently weighted first adder weights 16 and/or second adder weights 36. This allows multiple users to exercise with different weights at exactly the same time without the second user having to wait until the first user finishes. For example, assume two people seek to exercise using a pair of thirty five pound dumbbells. This can be achieved by the first user nesting the pair of fifteen pound dumbbells 6 into the pair of twenty pound first adder weights 16 and by the second user coupling the pair of five pound dumbbells 6 into the pair of thirty pound first adder weights 16. Neither user has to wait for the other one to finish. This is a further advantage of this invention compared to a traditional set of dumbbells.

Moreover, owners and operators of different exercise facilities can tailor or adjust the mix of dumbbells 6 and first adder weights 16 relative to one another and relative to second adder weights 36 if any are even used to better meet the needs of their clientele. Suppose the exercise facility is in one in a senior living exercise facility having elderly people who never need dumbbells that weigh above 30 pounds. In that scenario, the owner or operator of the exercise facility might order a set of dumbbells having eight pairs of dumbbells 6 in two and a half pound increments within the range from two and a half pounds to ten pounds, e.g., double sets of pairs of dumbbells weighing two and a half pounds, five pounds, seven and a half pounds and ten pounds, respectively, and then provide five pairs of first adder weights in five pound increments within the range from ten pounds to twenty pounds, e.g. two pairs of ten pound first adder weights 16, two pairs of fifteen pound first adder weights 16, and one pair of twenty pound first adder weights 16. Such a set would weigh a total of only one hundred twenty pounds.

Despite its light weight, the set described in the preceding paragraph provides even more opportunity for multiple users to exercise at the same weight. For example, assume that four users wish to exercise with twenty pound dumbbells at the same time. This can be done in the custom designed set described above by coupling the two pairs of ten pound dumbbells 6 to the two pairs of ten pound first adder weights 16 and by coupling the two pairs of five pound dumbbells 6 to the two pairs of fifteen pound first adder weights 36, thereby accommodating a total of four users at once. By being able to tailor how many dumbbells 6 one orders and the distribution of the weight increments and weight ranges of dumbbells 6 as well as the numbers and the distributions of the weight increments and weight ranges of first adder weights 16 and second adder weights 36 if second adder weights are even desirable, one can optimize dumbbell set 2 of this invention for a particular clientele. Obviously, for a dumbbell set 2 for professional athletes or body building enthusiasts, the owner or operator of the exercise facility serving them would skew the same distributions of dumbbells and the adder weights to the heavy side rather than the light side.

Various modifications of this invention will be apparent to one of ordinary skill in the art. Thus, the scope of the invention shall not be limited to the details of the various embodiments disclosed herein, but only by the appended claims.

The invention claimed is:

1. A dumbbell set, which comprises:

(a) a plurality of dumbbells of different weights having a substantially common length; and (b) a plurality of first adder weights of different weights, each first adder weight having a cavity of a substantially common length which exceeds the substantially common lengths of the plurality of dumbbells to permit any one of the plurality of dumbbells to be nested in the cavity of any one of the first adder weights such that an exercise mass provided to a user is a sum of the weight of the any one dumbbell and the weight of the any one first adder weight that have been nested together.

2. The dumbbell set of claim 1, further comprising a first retainer that secures the any one dumbbell and the any one first adder weight together during use by the user in performing dumbbell exercises.

3. The dumbbell set of claim 1, wherein the any one dumbbell when nested in the cavity of the any one first adder weight is substantially completely nested within the cavity.

4. The dumbbell set of claim 2, wherein the first retainer overlies and is above the cavity and the any one dumbbell dropped into the cavity when the first retainer is in place.

5. The dumbbell set of claim 4, wherein the first retainer comprises a slide member that slides substantially horizontally into an upper slideway in the any one first adder weight.

6. The dumbbell set of claim 5, wherein the slide member has a window therein which permits a user to reach down through the window to grip a hand grip of the dumbbell when the first retainer is in place.

7. The dumbbell set of claim 5, wherein the slide member is a substantially planar member.

8. The dumbbell set of claim 4, wherein the first retainer has a window therein which permits a user to reach down through the window to grip a hand grip of the dumbbell when the first retainer is in place.

9. The dumbbell set of claim 1, wherein the plurality of dumbbells comprise a plurality of pairs of dumbbells that have a weight distribution covering a predetermined range of weights in predetermined increments with at least one pair of dumbbells being at each increment within the range.

10. The dumbbell set of claim 9, wherein the plurality of first adder weights comprise a plurality of pairs of first adder weights that have a weight distribution covering a predetermined range of weights in predetermined increments with at least one pair of first adder weights being at each increment within the range.

11. The dumbbell set of claim 1, wherein the first adder weights have a substantially common length.

12. The dumbbell set of claim 11, further including a plurality of second adder weights having a cavity of a substantially common length which exceeds the substantially common lengths of the first adder weights, and wherein an assembly comprising any one of the dumbbells nested in any one of the first adder weights may be further nested in the cavity of any one of the second adder weights such that the exercise mass provided to the user is a sum of the weight of the any one dumbbell, the weight of the any one first adder weight, and the weight of the any one second adder weight.

13. The dumbbell set of claim 12, wherein the plurality of second adder weights comprises at least one pair of second adder weights.

14. The dumbbell set of claim 1, wherein the any one dumbbell when nested in the cavity of the any one first adder weight rests upon a lower support surface provided adjacent a bottom of the cavity.

15. The dumbbell set of claim 14, wherein the lower support surface is formed by inwardly facing flanges provided on opposite sides of the cavity in which the any one dumbbell is nested.

16. The dumbbell set of claim 14, further comprising a first retainer that secures the any one dumbbell and the any one first adder weight together during use by the user in performing dumbbell exercises, wherein the first retainer is selectively engageable by a user and when so engaged is positioned above the lower support surface to hold the any one dumbbell against the lower support surface of the any one first adder weight.

17. The dumbbell set of claim 16, wherein the first retainer when selectively engaged by the user to hold the any one dumbbell against the lower support surface of the any one first adder weight is positioned above and adjacent to a top of the any one dumbbell to vertically capture the any one dumbbell between the retainer and the lower support surface of the any one first adder weight.

18. A dumbbell set, which comprises:

(a) a plurality of dumbbells of different fixed non-adjustable weights having a substantially common length;

(b) a plurality of first adder weights of different weights, each first adder weight having a cavity of a substantially common length which exceeds the substantially common lengths of the plurality of dumbbells to permit any one of the plurality of dumbbells to be nested in the cavity of any one of the first adder weights such that an exercise mass provided to a user is a sum of the weight of the any one dumbbell and the weight of the any one first adder weight that have been nested together; and (c) a retainer that secures the nested any one dumbbell and the any one first adder weight together during use by the user in performing dumbbell exercises.

* * * * *